US005273447A

United States Patent [19]

Heiney et al.

[11] Patent Number: 5,273,447

[45] Date of Patent: Dec. 28, 1993

[54] PIN CONNECTOR

[75] Inventors: Francis M. Heiney; John P. Gallucci, both of Harrisburg, Pa.

[73] Assignee: The Whitaker Corporation, Wilmington, Del.

[21] Appl. No.: 857,708

[22] Filed: Mar. 25, 1992

Related U.S. Application Data

[63] Continuation of Ser. No. 489,647, Mar. 6, 1990, abandoned.

[51] Int. Cl.[5] ..... H01R 13/62

[52] U.S. Cl. ..... 439/160; 439/492

[58] Field of Search ..... 439/152-160, 439/492-499

[56] References Cited

U.S. PATENT DOCUMENTS

| | | | |
|---|---|---|---|
| 4,070,081 | 1/1978 | Takahashi | 339/91 R |
| 4,105,275 | 8/1978 | Dixon et al. | 339/91 R |
| 4,152,038 | 5/1979 | Inouye et al. | 339/75 M |
| 4,178,051 | 12/1979 | Kocher et al. | 339/45 M |
| 4,241,966 | 12/1980 | Gomez | 439/157 |
| 4,410,222 | 10/1983 | Enomoto et al. | 339/17 F |
| 4,447,101 | 5/1984 | Gugliotti | 439/153 |
| 4,579,408 | 4/1986 | Sasaki | 339/45 M |
| 4,582,378 | 4/1986 | Fruchard | 439/157 |
| 4,640,565 | 2/1987 | Hasircoglu | 339/45 M |
| 4,648,009 | 3/1987 | Beun et al. | 361/399 |
| 4,681,382 | 7/1987 | Lockard | 439/92 |
| 4,761,141 | 8/1988 | Hawk et al. | 439/153 |
| 4,902,243 | 2/1990 | Davis | 439/405 |
| 4,921,442 | 5/1990 | Puerner | 439/499 |

FOREIGN PATENT DOCUMENTS

| | | | |
|---|---|---|---|
| 2812631 | 10/1978 | Fed. Rep. of Germany | 439/153 |
| 1596006 | 8/1981 | United Kingdom . | |
| 2082401 | 3/1982 | United Kingdom | 439/152 |
| 2166300 | 4/1986 | United Kingdom | 439/155 |

OTHER PUBLICATIONS

AMP catalog "Ribbon Cable Connector System (Amp-Latch)", #73-177, streamlined Mar. 1989 p. 12.

Circuit Assembly Corp. Standard Product Catalog SF8902 p. 8.

3M Electronic Interconnection Systems 80-6106-999-6 p. C-2.

Thomas A. Betts Mass Termination IDC Systems IDC-3 Jun. 1987 p. 44.

*Primary Examiner*—David L. Pirlot

*Attorney, Agent, or Firm*—David L. Smith

[57] ABSTRACT

There is disclosed a pin connector (20) for insulation displacement termination of conductors (162) of a multiple conductor cable (156) having a housing (32) having insulation displacement contacts (26) secured therein. Each of the insulation displacement contacts (26) has an insulation displacement portion (46) extending beyond a cable receiving face (48) for terminating to conductors of a multiconductor cable (156). A termination cover (28) securable to the housing (32) is adapted to be pressed toward the cable receiving face (48) to terminate conductors (162) of the cable (156) to respective contacts (26). The termination cover (28) either has a latch/eject lever (30) secured thereto or is adapted to have secured thereto at least one latch/eject lever (30) for latchingly securing a mating connector (44) to the pin connector (20).

3 Claims, 5 Drawing Sheets

PIN CONNECTOR

This application is a continuation of application Ser. No. 07/489,647 filed Mar. 6, 1990, now abandoned.

BACKGROUND OF THE INVENTION

The present invention relates to pin connectors and in particular to pin connectors having insulation displacement contacts and a termination cover, securable to the pin connector, either having or adapted to receive a latch/eject lever.

The use of latch/eject levers is known. U.S. Pat. No. 4,761,141 discloses a shroud for positioning over pins in a pin field that can be latchingly secured to pins in the pin field by a latch/eject lever. A shrouded pin header is disclosed in U.S. Pat. No 4,178,051 capable of being soldered to a printed circuit board and latchingly securing a mating connector in a cavity in the shrouded pin header.

SUMMARY OF THE INVENTION

In accordance with the present invention, a pin connector for insulation displacement termination of conductors of a multiple conductor cable has a housing having insulation displacement contacts secured therein. Each of the insulation displacement contacts has an insulation displacement portion extending beyond a cable receiving face for terminating to conductors of a multiconductor cable. A termination cover securable to the housing is adapted to be pressed toward the cable receiving face to terminate conductors of the cable to respective contacts. The termination cover either has a latch/eject lever secured thereto or is adapted to have secured thereto at least one latch/eject lever for latchingly securing a mating connector to the pin connector.

DESCRIPTION OF THE PREFERRED EMBODIMENT

Figure 1:
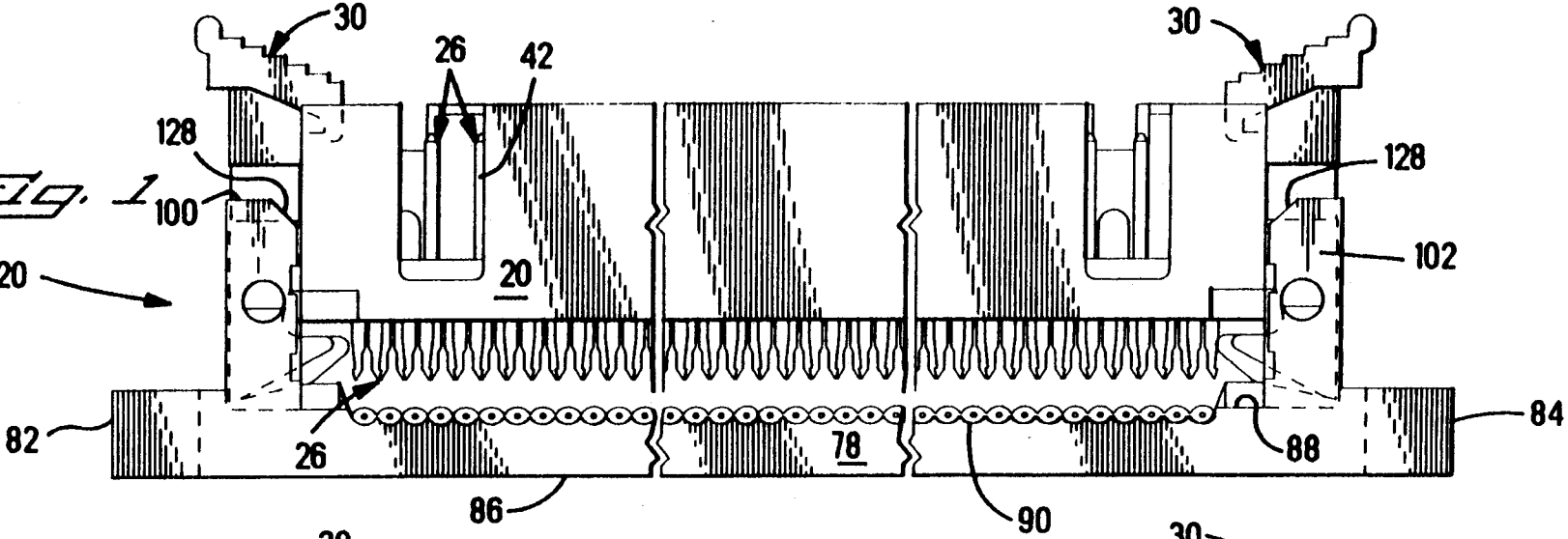
FIG. 1 is a side view of a pin connector in accordance with the present invention, with the termination cover in a pretermination position, and with a ribbon cable positioned to be terminated therein.

A pin connector 20 in accordance with the present invention is shown in FIG. 1. Pin connector 20 includes shroud 22 having an array 24 of contacts 26 secured therein and terminating cover 28 having latch/eject levers 30 secured therein, or adapted to have latch/eject levers 30 secured therein.

Shroud 22 has an elongate housing 32 molded of insulative material having a U-shaped cross section. Housing 32 has a base 34 having walls 36 integral with side edges thereof and extending normally to an inside floor 38 of base 34. Walls 36 and floor 38 define cavity 40. Contacts 26 are secured in base 34 with a pin portion 42 extending into cavity 40, protected by walls 38, for mating with receptacle contacts (not shown) in a complementary connector 44 (see FIG. 2), also received in cavity 40. Complementary connector 44 could take many forms, such as part number 746290 manufactured by the assignee. Each contact 26 also has an insulation piercing portion 46 extending beyond a cable receiving face 48 on the opposite side of base 34 from floor 38.

Walls 36 provide protection for pin portions 42 and may have slots 50 formed therein to receive polarization features of complementary connector 44. While a particular polarization feature has been shown, walls 36 may be modified by appropriate molding to accommodate other forms of polarization such as a single slot or military polarization.

Figure 4:
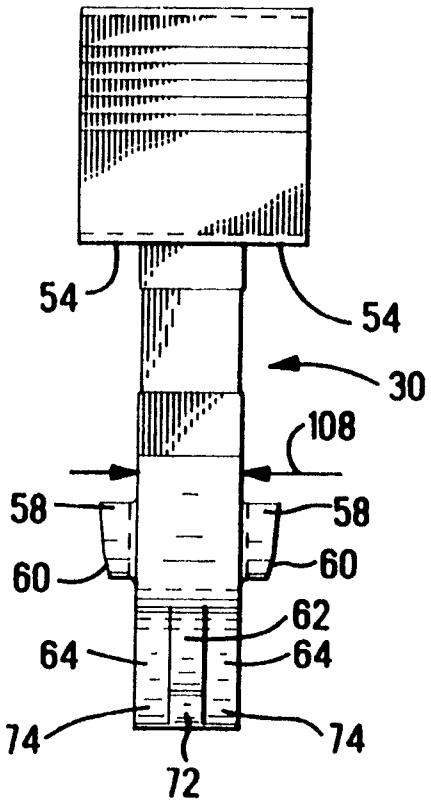
FIG. 4 is an end view of a latch/eject lever.
Figure 3:
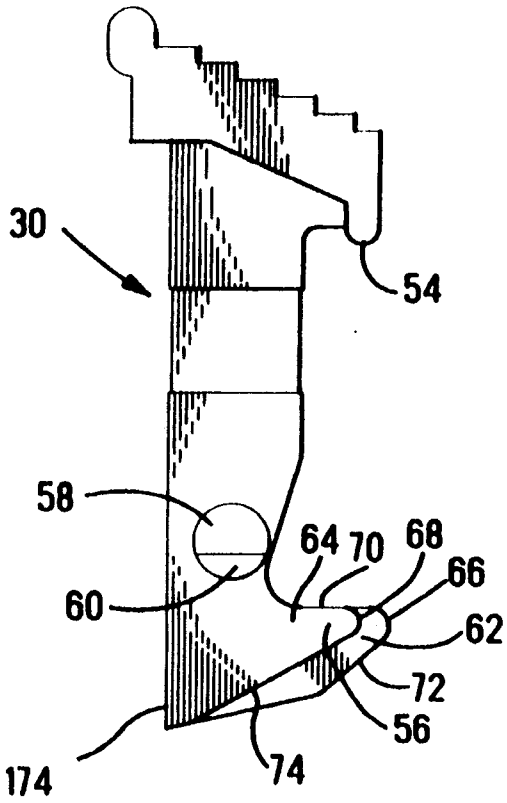
FIG. 3 is a side view of a latch/eject lever.

A latch/eject lever 30 is shown in FIGS. 3 and 4. It is understood that while the latch/eject lever 30 of the preferred embodiment will be described as performing the dual functions of latching complementary connector 44 in a mated position in cavity 40 and ejecting complementary connector 44 from the mated position in cavity 40, these functions may be performed independently. Accomplishing either of these functions independently with the terminating cover described herein is contemplated as within the scope of the invention. Thus, the notation latch/eject lever or lever shall mean either a latch lever, an eject lever or a lever that is capable of performing both functions.

Lever 30 has a latching shoulder 54, a foot 56 and an integral pivot shaft 58. Pivot shaft 58 has a tapered end 60 to facilitate insertion as will be described in more detail below. Foot 56 has central portion 62 that extends beyond side portions 64, with both central portion 62 and side portions 64 forming rounded edges, respectively 66 and 68, as they merge to form the upper surface 70 of foot 64. Central portion 62 and side portions 64 have respective under surfaces 72,74.

Figure 5:
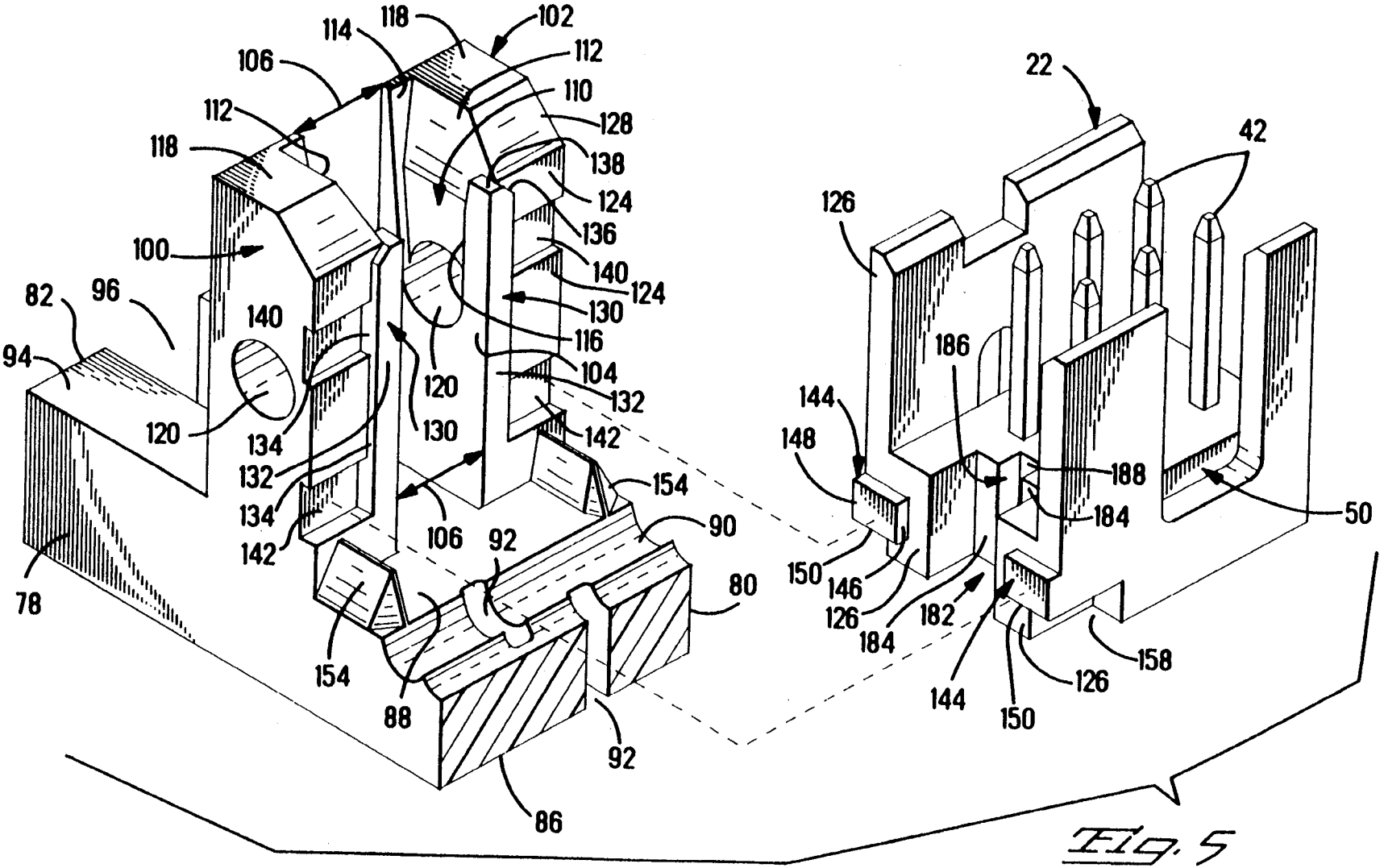
FIG. 5 is a perspective view of the termination cover securing system.
Figure 7:
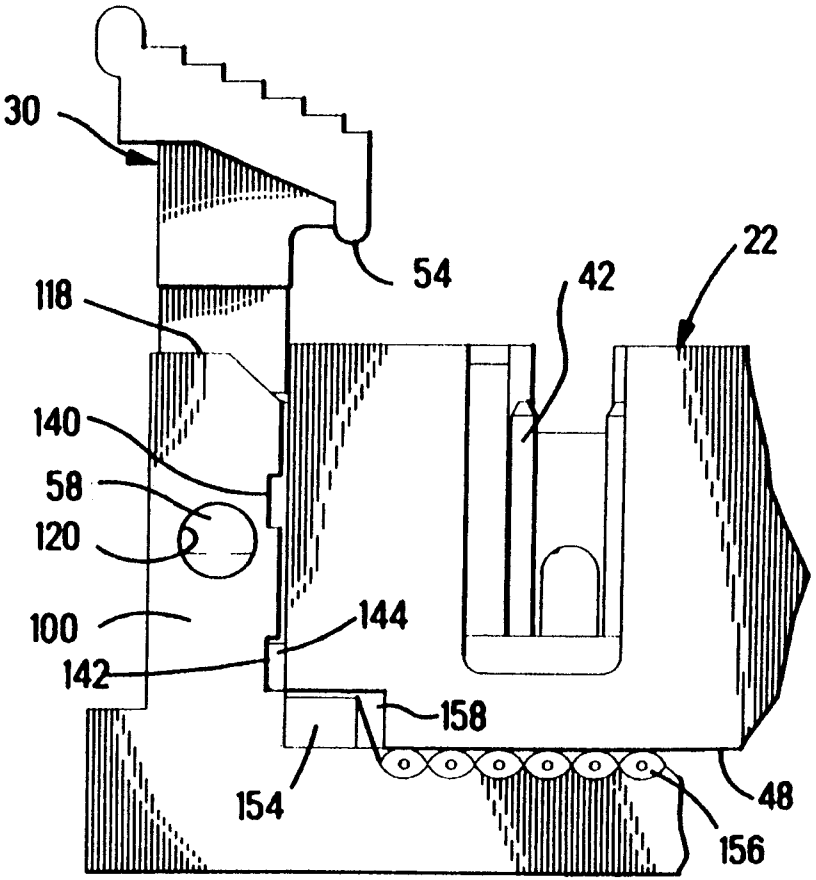
FIG. 7 is an enlarged partial side view of a pin connector showing the termination cover secured in the terminated position, with a cable terminated in the pin connector.
Figure 6:
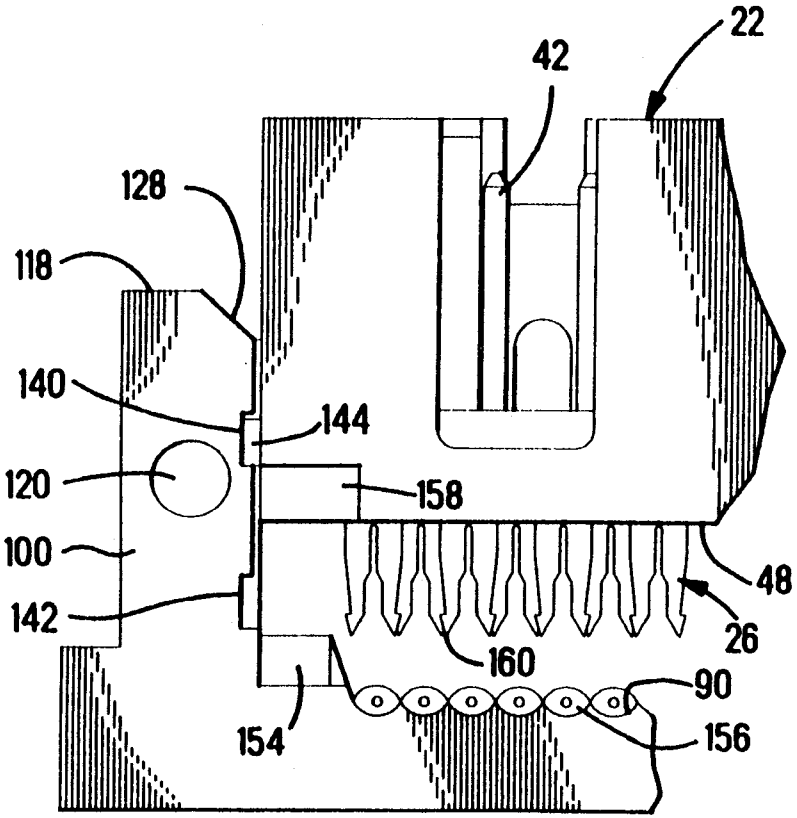
FIG. 6 is an enlarged partial side view of a pin connector showing the termination cover secured in the pretermination position.

Terminating cover 28 is elongate having opposed side walls 78,80, opposed end walls 82,84, outer surface 86 and opposed inner surface 88, a portion of which forms fluted surface 90. Terminating cover 28 has recesses or apertures 92, in accordance with the teaching of U.S. Pat. Nos. 3,820,055, 4,410,229 or 4,781 615 the disclosures of which hereby incorporated by reference. Apertures 92 receive the leading sections of insulation piercing portions 46. Terminating cover 28 may have flanges 94 for securing pin connector 20 to a circuit board or back panel of a computer. Flanges 94 may have a slot 96 as shown in FIGS. 5-7 or an aperture to receive a bolt or threaded insert as are known in the art. Absent the need for features to anchor pin connector 20 to a circuit board or back panel, flanges 94 may be terminated such as at line 98 in FIG. 8.

Spaced leg means 100,102 extend from inner surface 88 proximate end walls 82,84. In the preferred embodiment, the leg means at each end of terminating cover 28 are identical and leg means at only one end will be described. Leg means 100,102 at one end of terminating cover 28 are spaced from leg means 100,102 at the other end of terminating cover 28 to receive and secure shroud 22 therebetween.

As best seen in FIG. 5, facing surfaces 104 of leg means 100,102 are spaced apart a distance 106 that is substantially the thickness 108 (see FIG. 4) of latch/eject lever 30 to receive latch/eject lever 30 therebetween. In the preferred embodiment, leg means 100,102 are mirror images of each other. Leg means 100,102 have opposed channels 110 having a chamfered lead-in 112. Chamfered lead-in 112 cooperates with tapered end 60 of pivot shaft 58 to facilitate positioning shaft 58 in channel 110. Surfaces 114,116 also assist in positioning shaft 58 as latch/eject lever 30 is assembled to terminating cover 28 by moving shaft 58 from end 112 toward inner surface 88. Shaft 58 seats in cylindrical aperture or recess 120 thereby securing latch/eject lever 30 to terminating cover 28 and simultaneously providing a pivot for latch/eject lever 30 upon pivotally securing latch/eject lever 30 to terminating cover 28. As latch/eject lever 30 is moved from end 118 toward inner surface 88 in channels 110, leg means 100,102 resiliently deflect outwardly and, upon shaft 58 seating in aperture or recess 120, leg means 100,102 resile inwardly to secure latch/eject lever 30 to terminating cover 28. Leg means 100,102 thus provide structure on the terminating cover adapted to have secured thereto at least one latch/eject lever.

Each of leg means 100,102 have an inside end surface 124 that faces the inside end surface of spaced leg means at the other end of terminating cover 28. Surfaces 124 on leg means 100,102 at the two ends of terminating cover 28 are spaced substantially as the end wall surfaces 126 at the two ends of housing 32 of shroud 22. As stated above, shroud 22 is received between inside end surfaces 124 of leg means 100,102 at the ends of the terminating cover. End walls 126 of shroud 22 slidingly engage surfaces 124 as shroud 22 is positioned between leg means at the ends of terminating cover 28, as best seen in the side views shown in FIGS. 1 and 2. Inside end surfaces 124 are tapered at 128 where they would otherwise intersect ends 118 of leg means 100,102. Tapers 128 assist in laterally positioning shroud 22 between the leg means at the two ends of terminating cover 28 as the shroud is positioned relative to terminating cover 28.

Guide rails 130 are raised above surfaces 124 defining surface 132 and extend substantially from taper 128 to inner surface 88. In the preferred embodiment, the facing surfaces of guide rails 130 are contiguous with and are merely an extension of facing surfaces 104.

On the opposite side of guide rails 130 from facing surfaces 104, guide rails 130 form protrusion engaging surfaces 134 which face outwardly toward side walls 78 and 80. Surfaces 134 are chamfered 136 at end 138 to assist in side-to-side positioning of shroud 22 relative to terminating cover 28.

Each of leg means 100,102 has a first transverse slot 140 spaced a first predetermined distance from inner surface 88 and recessed from surface 124 and a second transverse slot 142 spaced a second predetermined distance from inner surface 88, between the first transverse slot 140 and inner surface 88. The second transverse slot 142 is also recessed from surface 124 and is substantially identical to first transverse slot 140. Guide rails 130 cooperate with protrusions 144 upstanding from end walls 126 to provide stability as shroud 22 is positioned on terminating cover 28. Side surface 146 of a protrusion 144 slides along a corresponding protrusion engaging surface 134 of a guide rail 130 while end surface 148 slides along a corresponding surface 132 of a corresponding guide rail. The corner edge 150 of a protrusion 144 may be rounded to facilitate movement.

Cable guides 154 extend from inner surface 88 along leg means 100,102 to guide cable 156 during insertion into pin connector 20 as well as during positioning cable 156 in fluted surface 90. Guides 154 also assist in positioning shroud 22 during termination and are received in recesses 158 in housing 32 during termination of cable 156.

Terminating cover 28 is preassembled onto shroud 22 in a pretermination position for ease of threading a ribbon cable between insulation piercing portions 46 and inner surface 90. In this manner, pin connector 22 is capable of being employed in daisy chain applications.

Prior to preassembling shroud 22 to terminating cover 28, shroud 22 is positioned above inner surface 88 between leg means 100,102 at the ends of terminating cover 28. As shroud 22 is moved toward inner surface 88 for preassembling to terminating cover 28, end walls 126 cooperate with tapers 128 to position shroud 22 from end-to-end relative to terminating cover 28, and chamfers 136 cooperate with protrusions 144 to position shroud 22 from side-to-side. The rounded corner edge 150 on protrusions 144, coupled with taper 128 assist in causing leg means 100,102 to resiliently deflect toward end walls 82,84 and may cause terminating cover to bow slightly such that end surfaces 148 of protrusions 144 are received between surfaces 124 on leg means 88 at the two ends of terminating cover 28 and side surfaces 146 of protrusions 144 slidingly engage and slide along protrusion engaging surfaces 134 to guide the cable receiving face 48 toward and substantially parallel to inner surface 88.

As shroud 22 is moved toward inner surface 88, protrusions 144 are received in respective first transverse slots 140 as shown in FIG. 1. Upon protrusions 144 seating in first transverse slots 140, leg means 100,102 resile inwardly to an unbiased position and terminating cover 28 also resiles to secure terminating cover 28 and shroud 22 in a pretermination position.

As shown in an enlarged view in FIG. 6, in the pretermination position there is sufficient space between ends 160 of insulation piercing portions 46 and the inner surface 88, specifically fluted surface 90, for threading a ribbon cable 156 and positioning the cable for termination in pin connector 20. At this stage, latch/eject levers 30 may or may not be positioned pivotally secured on terminating cover 28.

To effect termination of cable 156 in pin connector 20, shroud 22 or terminating cover 28 are moved toward the other to terminate individual conductors 162 to respective ones of the insulation piercing portions 46 of contacts 26. Typically, outer surface 86 will be positioned against a surface and a tool (not shown) is positioned in cavity 40 to extend over pin portions 42 and press on floor 38 to cause shroud 22 to move from a pretermination position to a termination position and in the process effect termination of conductors of the cable to insulation piercing portions of the contacts in a known manner.

Figure 2:
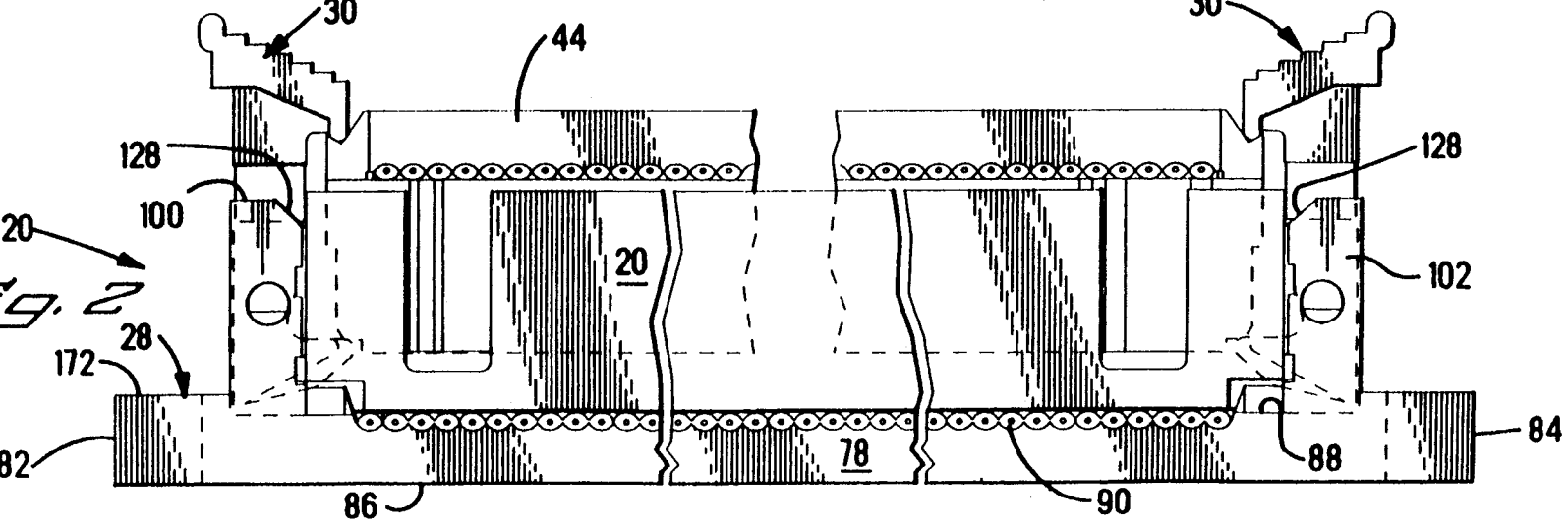
FIG. 2 is a side view of the pin connector of FIG. 1 with the termination cover in a terminated position and a mating connector installed.

In moving from the pretermination position, leg means 100,102 again resiliently deflect toward end walls 82,84 and terminating cover 28 may bow slightly such that end surfaces 148 of protrusions 144 ride out of first transverse slots 140, facilitated by rounded corner edge 150, and slidingly engage surfaces 124 as side surface 146 slidingly engages protrusion engaging surface 134 to guide the cable receiving face 48 toward and substantially parallel to inner surface 88 until protrusions 144 are received in respective second transverse slots 142 as shown in FIGS. 2 and 7. Upon protrusions 144 seating in second transverse slot 142, leg means 100,102 resile inwardly to an unbiased position and terminating cover 28 also resiles to secure terminating cover 28 and shroud 22 in a terminated position. In the terminated position, cable 156 is secured between cable receiving face 48 and inner surface 88, specifically inner surface 90.

Terminating cover 28 can be terminated to a cable as described above with or without latch/eject levers 30 secured therein. With latch/eject levers 30 secured in terminating cover 28, the latch/eject levers do not interfere with the tooling or the termination process. In the event that termination is effected without latch/eject levers 30 secured in terminating cover 28, the levers can be installed subsequent to termination.

Figure 9:
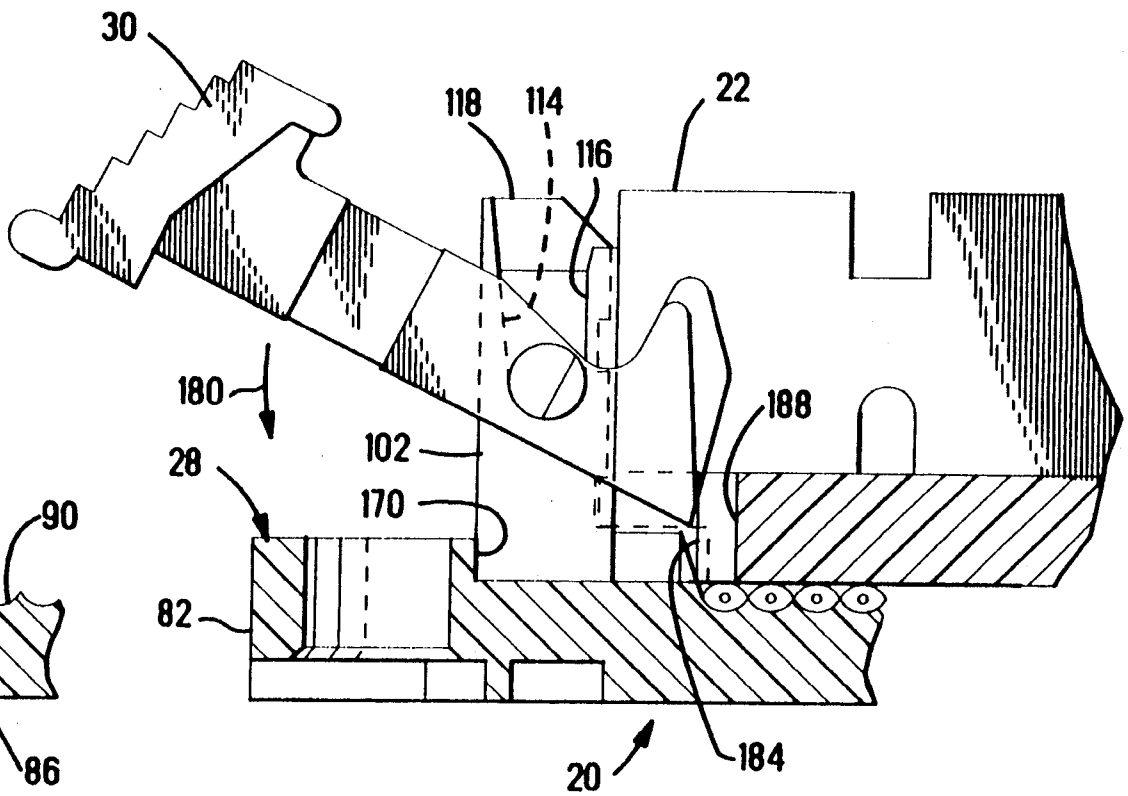
FIG. 9 is a partial side view of the terminating cover and shroud showing a counter clockwise stop.
Figure 8:
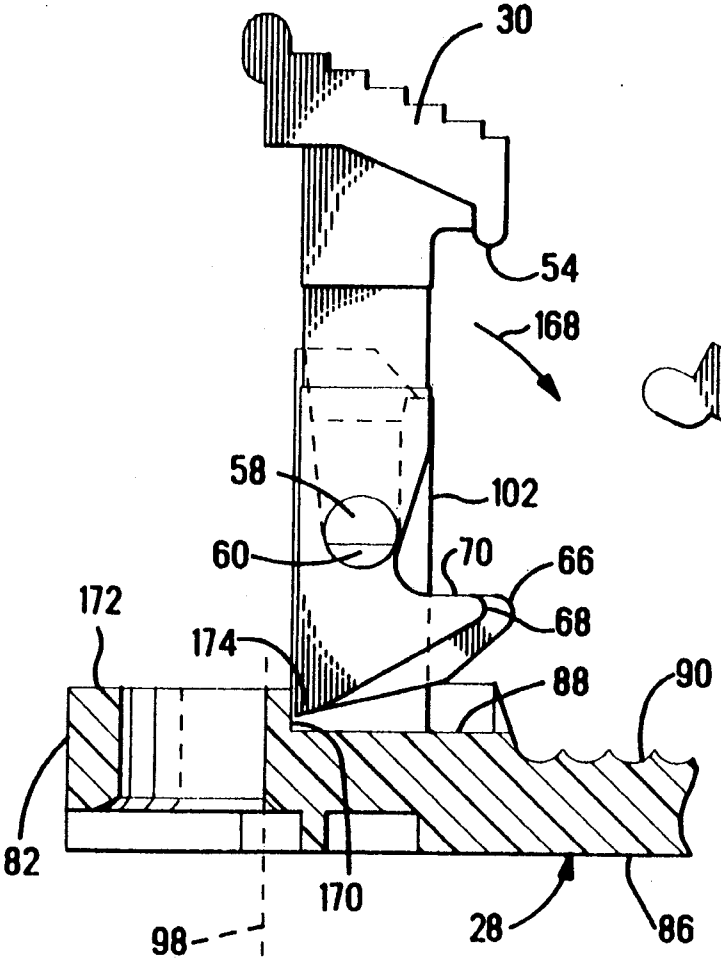
FIG. 8 is a partial side view of the terminating cover showing a clockwise latch/eject lever stop.

As best seen in FIGS. 8 and 9, stops are provided to prevent undesired clockwise or counter clockwise movement of latch/eject levers 30. With reference to FIG. 8, clockwise movement of latch/eject lever 30, as indicated by arrow 168, beyond a vertical position is prevented by providing a stop shoulder 170 defined by a differential elevation between inner surface 88 and the upper surface 172 of flange 94. While end 174 of latch/eject lever 30 clears inner surface 88 in its arcuate path as latch/eject lever 30 pivots on shaft 58, end 174 engages stop shoulder 170 preventing further counter clockwise movement. This stop is effective whether or not shroud 22 is secured to terminating cover 28.

With reference to FIG. 9, with termination cover 28 secured in the termination position relative to shroud 22, further counter clockwise movement of latch/eject lever 30, from the position shown and as indicated by arrow 180, is prevented. Foot 56 is received in recess 182 (see FIG. 5) with edges 68 of side portions 64 clearing surfaces 184 and edge 66 of central portion 62 passing through further recess 186, clearing surface 188 in their respective arcuate paths as latch/eject lever 30 pivots about shaft 58. Under surface 74 on side portions 64 engage respective surfaces 184, recessed from end walls 126 to provide a counter clockwise stop. The counter clockwise stop, as shown in FIG. 9, provides a limit to the arcuate counter clockwise travel of latch/eject lever 30.

We claim:

1. A connector for insulation displacement termination of conductors of a multiple conductor cable, comprising:

a housing having insulation displacement contacts secured therein, each of said insulation displacement contacts having an insulation displacement portion extending beyond a cable receiving face for termination to a conductor of the multiple conductor cable, said housing further having an end-wall, said end-wall having a recess defining a recess wall, said recess wall having a further recess therein;

a termination cover securable to said housing, said termination cover movable from a pre-termination position where a cable can be positioned in the connector for termination toward the cable receiving face to a termination position to terminate conductors of the multiple conductor cable to the insulation displacement portion of respective contacts, said termination cover having leg means extending from an inner surface, said leg means adapted to receive and secure a latch/eject lever; and a latch/eject lever secured in said leg means, said latch/eject lever having a surface that engages the recess wall to limit travel of the lever when the housing is in the termination position, said latch/eject lever having a foot having a forward extending portion for arcuately passing through said further recess as the latch/eject lever is rotated to eject a complementary connector.

2. A connector as recited in claim 1, and further comprising:

said leg means comprising a pair of spaced deflectable legs, said latch/eject lever being between said legs, a pivot shaft on said latch/eject lever being rotatably received in recesses in the pair of legs, and the pair of legs being adapted to deflect apart to allow passage of the shaft between the legs and into the recesses.

3. A connector as recited in claim 2, comprising: said shaft being tapered on opposite ends to facilitate passage of the shaft against said legs and into said recesses.

* * * * *